United States Patent [19]

Lafrasse et al.

[11] Patent Number: 4,625,531

[45] Date of Patent: Dec. 2, 1986

[54] BENDING MACHINE

[75] Inventors: Jean Lafrasse, Dardilly; Jean-Paul Chastan, Ecully, both of France

[73] Assignee: Picot S.A., Tassin la Demi Lune, France

[21] Appl. No.: 753,314

[22] Filed: Jul. 9, 1985

[30] Foreign Application Priority Data

Jul. 10, 1984 [FR] France ..... 84 11321

[51] Int. Cl.[4] ..... B21D 7/04; B21D 9/05

[52] U.S. Cl. ..... 72/150

[58] Field of Search ..... 72/149, 150, 154, 155, 72/156, 157, 159

[56] References Cited

U.S. PATENT DOCUMENTS 2,740,454 4/1956 Fuchs ..... 72/159 X
4,063,441 12/1977 Eaton ..... 72/151

FOREIGN PATENT DOCUMENTS 1962590 6/1971 Fed. Rep. of Germany ..... 72/157
2910174 9/1980 Fed. Rep. of Germany .
2121756 8/1972 France .

*Primary Examiner*—E. Michael Combs
*Attorney, Agent, or Firm*—Karl F. Ross; Herbert Dubno

[57] ABSTRACT

A machine for bending an elongated workpiece extending along a longitudinal axis has a housing and a holder on the housing for retaining the workpiece with its axis nondisplaceable relative to the housing and for advancing the workpiece in a feed direction parallel to the axis. A support defining a mandrel axis transverse to the longitudinal axis and spaced transversely therefrom is displaceable with the mandrel axis on the housing transverse to the longitudinal workpiece axis. A mandrel carried directly on the support is formed with an arcuate groove centered on the mandrel axis. This mandrel carries an inner jaw forming a continuation of the groove and is rotatable therewith on the support about the mandrel axis. An arm mounted directly on the support pivotal about the mandrel axis carries an outer jaw generally complementary to the inner jaw and a guide carried directly on the housing mainly upstream of the mandrel has a guide groove confronting the groove of the mandrel and centered on the longitudinal workpiece axis. A jaw actuator can displace the outer jaw on the arm radially of the mandrel axis. A guide actuator can displace the guide on the housing transversely of the feed direction and independently of the support. A support actuator displaces the support and the jaws and mandrel carried thereby transverse to the direction and independently of the guide. A pivot actuator pivots the support about the mandrel axis to bend the workpiece between the jaws and the guide.

2 Claims, 12 Drawing Figures

BENDING MACHINE

FIELD OF THE INVENTION

The present invention relates to a machine for bending an elongated workpiece such as a tube, profile, or bar. More particularly this invention concerns such a machine which can perform multiple bends in workpieces of noncircular section.

BACKGROUND OF THE INVENTION

A standard bending machine has a housing, a holder on the housing for retaining the workpiece with its axis nondisplaceable and normally horizontal relative to the housing and for advancing the workpiece in a feed direction parallel to the axis, and a mandrel formed with an arcuate groove centered on an axis transverse to the longitudinal axis and spaced transversely therefrom. This mandrel carries an inner jaw forming a continuation of the groove and rotatable with the mandrel about the mandrel axis. An arm pivotal on the housing about the mandrel axis carries an outer jaw generally complementary to the inner jaw. A guide mainly upstream of the mandrel has a guide groove confronting the groove of the mandrel and centered on the longitudinal workpiece axis. The workpiece held in the holding means fits in the grooves of the guide and mandrel simultaneously. An actuator pivots the support about the mandrel axis to bend the workpiece between the jaws and the guide.

Thus with this system the two jaws grip the workpiece and then the mandrel pivots with both the jaws. This bends the workpiece through an angle determined by the amount the jaws and mandrel pivot and gives the bend thus formed a curvature corresponding to that of the mandrel. The bending operation typically advances the workpiece slightly longitudinally, and the guide prevents any bending of the workpiece downstream of the mandrel.

In this type of arrangement the guide, mandrel, and inner jaw are mounted on a common transversely displaceable support. Thus when the transverse dimension of the workpiece change it is necessary to change the mandrel and both jaws for the new workpiece, and then to appropriately reposition the guide which must be moved on the subassembly. Obviously this is a cumbersome and difficult procedure incurring quite some down time between runs.

Another disadvantage of these arrangements is that they only allow multiple nonaligned curves or opposite curves to be formed on circular-section workpieces. Square- or other polygonal-section workpieces cannot be rotated while engaged with the mandrel and guide to form nonaligned bends.

OBJECTS OF THE INVENTION

It is therefore an object of the present invention to provide an improved bending machine.

Another object is the provision of such a bending machine which overcomes the above-given disadvantages, that is which is easy to set up.

A further object is to provide a bending machine and method of operating it that allows noncircular-section workpieces to be multiply bent.

SUMMARY OF THE INVENTION

A machine for bending an elongated workpiece extending along a longitudinal axis according to the invention has a housing and a holder on the housing for retaining the workpiece with its axis nondisplaceable relative to the housing and for advancing the workpiece in a feed direction parallel to the axis. A support defining a mandrel axis transverse to the longitudinal axis and spaced transversely therefrom is displaceable with the mandrel axis on the housing transverse to the longitudinal workpiece axis. A mandrel carried directly on the support is formed with an arcuate groove centered on the mandrel axis. This mandrel carries an inner jaw forming a continuation of the groove and is rotatable therewith on the support about the mandrel axis. An arm mounted directly on the support pivotal about the mandrel axis carries an outer jaw generally complementary to the inner jaw and a guide carried directly on the housing mainly upstream of the mandrel has a guide groove confronting the groove of the mandrel and centered on the longitudinal workpiece axis. A jaw actuator can displace the outer jaw on the arm radially of the mandrel axis. A guide actuator can displace the guide on the housing transversely of the feed direction and independently of the support. A support actuator displaces the support and the jaws and mandrel carried thereby transverse to the direction and independently of the guide. A pivot actuator pivots the support about the mandrel axis to bend the workpiece between the jaws and the guide.

Thus the method according to this invention comprises the steps of first transversely displacing the jaws, guide, and mandrel against the workpiece so the workpiece lies in the grooves and is snugly engaged at the mandrel and then pivoting the mandrel and the arm with the second jaw through an acute angle to bend the workpiece around the mandrel, during which step the guide prevents bending of the workpiece upstream in the feed direction of the mandrel. The guide is then displaced in one transverse direction away from the bent workpiece, the mandrel and inner jaw are displaced transversely oppositely away from the bent workpiece, and the second jaw is moved transversely away from the bent workpiece. The workpiece is then advanced in the feed direction and rotated about its axis, whereupon the jaws, guide, and mandrel can be moved back in and another bend formed. When the workpiece is of polygonal section with corners and the jaws, guide, and mandrel are sufficiently retracted transversely to allow it to be rotated after it is first bent without the corners engaging the jaws, guide, or mandrel.

In order further to unencumber the machine, and make changing tools easier, the outer jaw is displaceable on the arm vertically and radially of the mandrel axis and is displaced first upward and toward the workpiece and after the workpiece is bent downward and away from the workpiece.

Thus with the system of this invention the mandrel is positioned independently of the guide, making setup very simple. The guide need not be moved each time the mandrel is, for instance when the mandrel is switched for one of the same radius of curvature but with a narrower groove.

According to features of this invention the support actuator includes a first positioner for relatively displacing the support and housing prior to pivoting of the support and bending of the workpiece, and a second positioner for relatively displacing the support and housing after pivoting of the support and bending of the workpiece. The first positioner includes a spindle extending transversely of the longitudinal axis and threaded in the support and a drive on the housing for rotating the spindle and the second positioner includes a hydraulic cylinder assembly braced between the support and the housing. The cylinder assembly is braced between the spindle and the housing and includes a cylinder fixed on the housing and a piston fixed on the spindle. The drive is an electric motor carried on the housing.

In addition in accordance with this invention the arm includes a slide carrying the outer jaw and a guide along which the slide can move between an upper position confronting and closely juxtaposed with the inner jaw and a lower position below and spaced radially of the mandrel axis from the inner jaw. The jaw actuator displaces the slide along its guide. Thus as mentioned above when the outer jaw is retracted it is moved below the inner jaw, making switching of both of these parts much easier.

DESCRIPTION OF THE DRAWING

The above and other features and advantages will become more readily apparent from the following, reference being made to the accompanying drawing in which.

SPECIFIC DESCRIPTION

Figure 1:
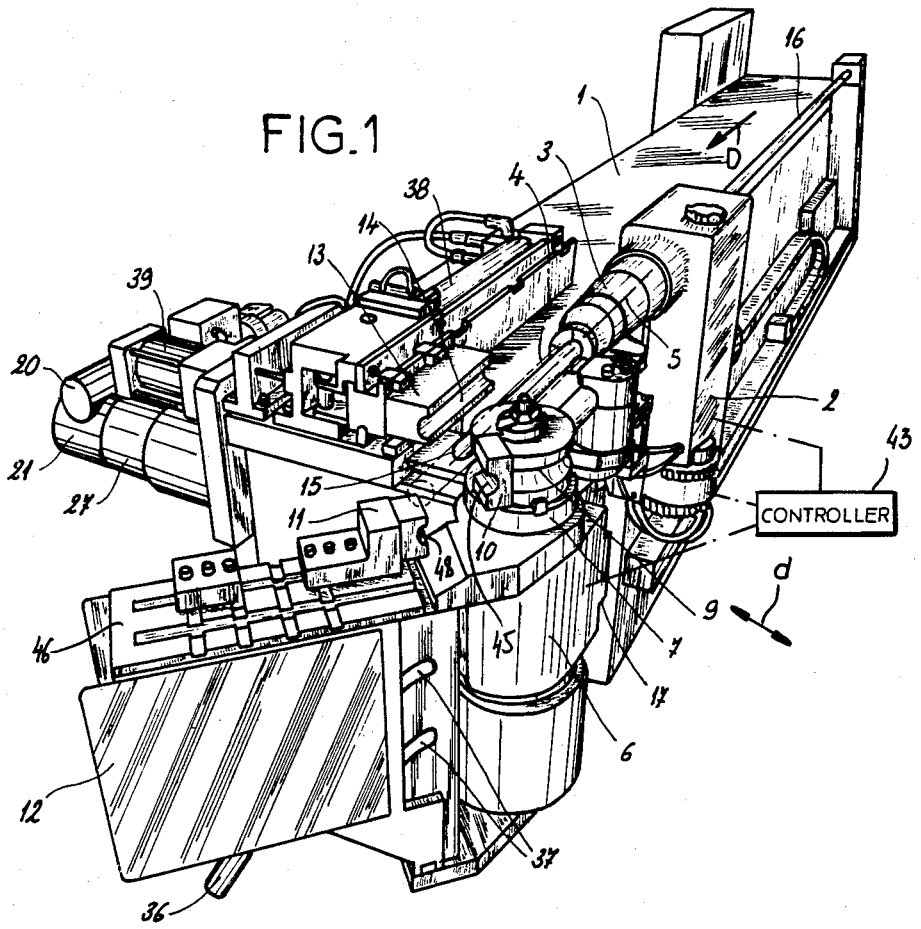
FIG. 1 is a perspective view of the bending machine according to this invention.
Figure 2:
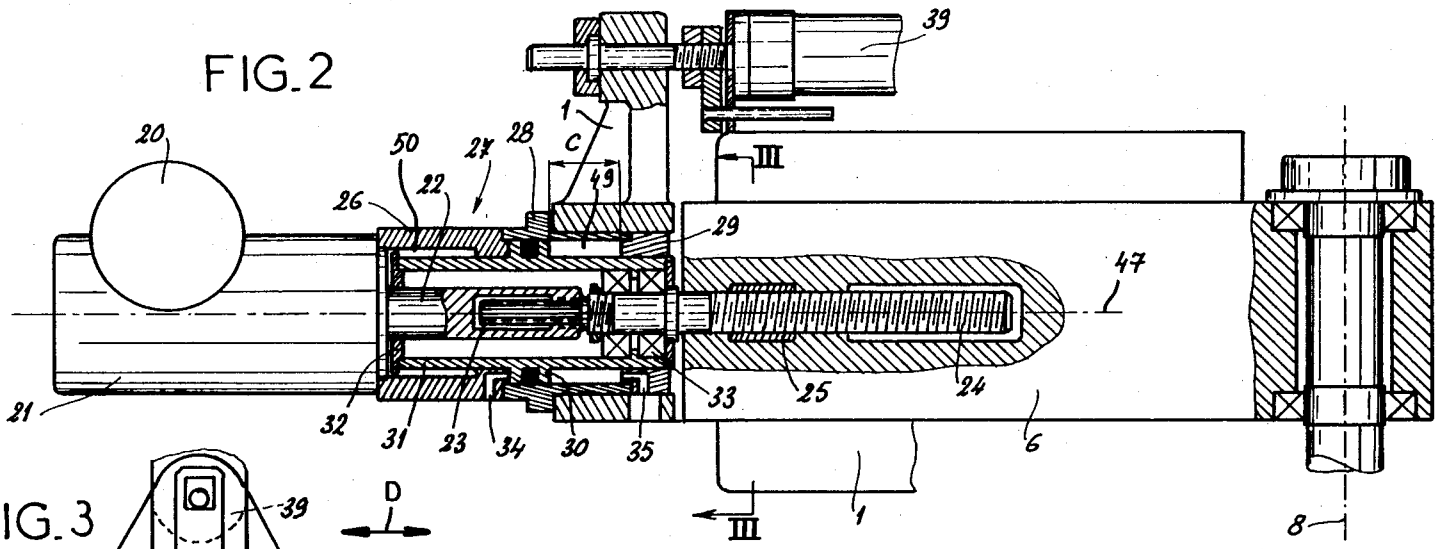
FIG. 2 is a large-scale partly sectional view of a detail of the machine of FIG. 1.
Figure 3:
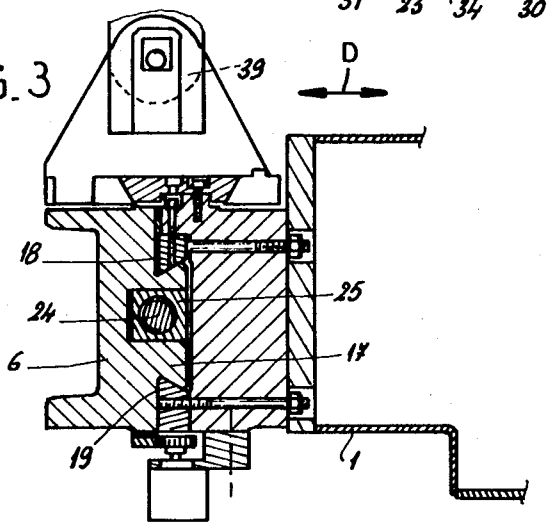
FIG. 3 is a section taken along line III—III of FIG. 2.

As seen in FIGS. 1 through 3 the bending machine according to this invention has a housing or bed 1 along which a carriage 2 supporting a vise or holder 3 can slide. This holder 3 grasps a workpiece 4, here a tube, centered on a longitudinal axis 5 and can advance this workpiece 4 longitudinally, that is parallel to the axis 5, in the direction D and can also rotate the gripped portion of the workpiece 4 about the axis 5, all under the command of a controller 43.

The housing 1 carries a support 6 for a forming mandrel 7 of the drum type formed centered on a vertical axis 8 with an annular outwardly open groove 9 and provided with an inner jaw 10 having a straight notch or groove 45 forming a straight continuation of the groove 9. This mandrel 7 and its inner jaw 10 can rotate on the support 6 about the axis 8.

An arm 12 can also rotate on the support 6 about the axis 8 and is connected to the mandrel 7 so that it rotates jointly with it, an actuator 44 (FIG. 6) being provided to effect such motion. This arm 12 has a slide 46 carrying an outer jaw 11 substantially identical to the inner jaw 20 and formed with a complementary notch 48. The jaw 11 and slide 46 are mounted via guides 37 on the support 6 so that an actuating cylinder 36 can displace the jaw 11 between the illustrated lower position with the jaw 11 below and spaced from the jaw 10 and an inner position with the jaws 10 and 11 engaged at the same level flatly with each other and their notches 45 and 48 concentric and forming a passage complementary to the workpiece 4.

Upstream in the direction D from the support 6 is a guide 13 formed with a longitudinal groove 14 always parallel to the axis 5. In addition a tip 15 of a mandrel core 16 projects through the holder 3 and through the tube 4 held thereby to the downstream end of the apparatus. This core 16 prevents flattening of a tubular workpiece 4.

As best seen in FIGS. 2 and 3 the support 6 is formed with a dovetail ridge 17 received between complementary guides 18 and 19 so that the entire support 6 and arm 12 can move in a direction d perpendicular to the direction D. To this end a motor 20 carried on the frame 1 has a right-angle transmission 21 whose output shaft 22 extends along an axis 47 parallel to the direction d and here in a vertical plane perpendicular to the axis 5. A splined end 23 of a threaded spindle 24 extending along the axis 47 engages in the shaft 22. This spindle 24 is threaded in a nut 25 fixed in the support 6 and is otherwise fixed relative to the axis 47 in a double-acting actuator 27 provided between the transmission 21 and the support 6.

More specifically this actuator 27 comprises an annular piston 30 formed on a sleeve 31 whose front end is guided in a ring 29 in a cylinder half 28 fixed on the housing 1. The front end of this sleeve 31 has bearings 33 in which the shaft 24 is rotatable but axially nondisplaceable and the rear end of the sleeve 31 is closed by a ring 32 around the shaft 22 inside the other cylinder half 26. Ports 34 and 35 open into the front and back compartments 49 and 50 thus formed and can be fed with high or low pressure from the controller 43 depending on which way the support 6 is to move, a total stroke c equal to a major portion of the transverse dimension of the workpiece 4 being possible.

In addition the housing 1 has a crosswise actuator 39 coupled to the guide 13 to move it horizontally perpendicular to the axis 5, and another such cylinder 38, also operated by the controller 43, can move the guide 13 horizontally parallel to the axis 5.

Figure 4:
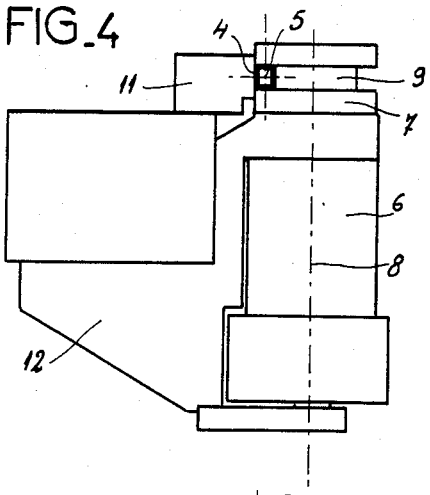
FIG. 4 is a small-scale end view of the bending machine in a first step of a bending operation.
Figure 5:
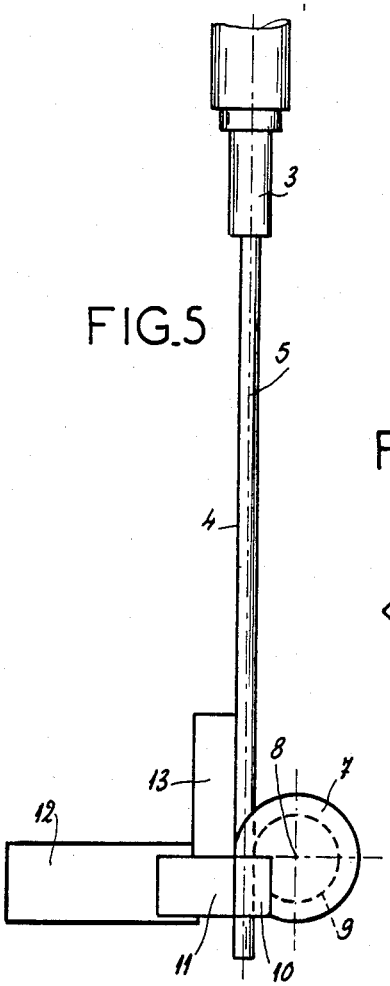
FIG. 5 is a top view of the machine in the first step of FIG. 4.

To start with the spindle 24 is rotated by the motor 20 to position the support 6 as well as the mandrel 7 and jaws 10 and 11 so that the workpiece 4 can be advanced along its axis 5 by the holder 3 and just slide through the passage formed by the two jaw notches 45 and 48. Meanwhile the guide 13 has been advanced toward the axis 5 so that the workpiece 4, when advanced, will slide along it also. In addition the actuator 36 has raised the slide 46 so that the jaws 10 and 11 meet and the actuator 44 has pulled the arm 12 to extend perpendicular to the axis A. The workpiece 4 is fed in and the system is in the position of FIGS. 4 and 5.

Figure 6:
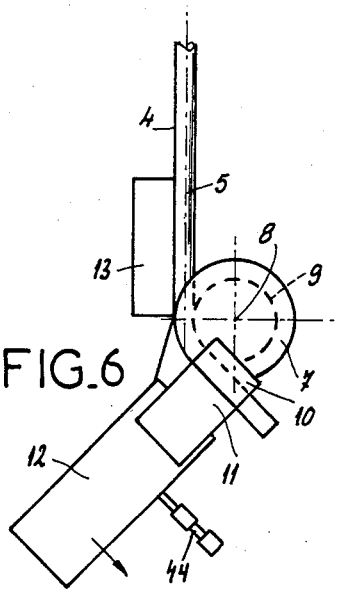
FIG. 6 is a top view of the machine in the second step of the bending operation.

Then the actuator 44 deflects the arm 12, jaws 10 and 11, and mandrel 7 about the axis as illustrated in FIG. 6. This bends the workpiece, the bend being shown at 40 in FIG. 8.

Figure 7:
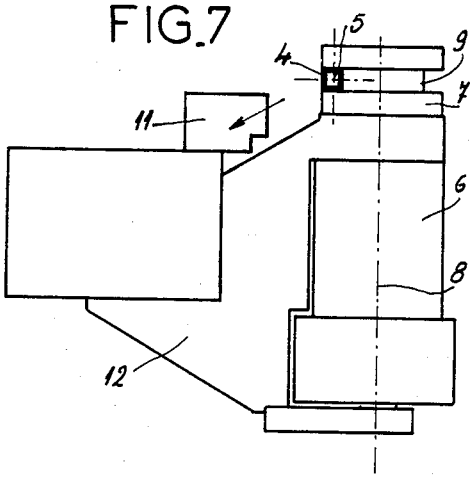
FIGS. 7 and 8 are views like respective FIGS. 4 and 5 showing the machine in the third step of the bending operation.
Figure 8:
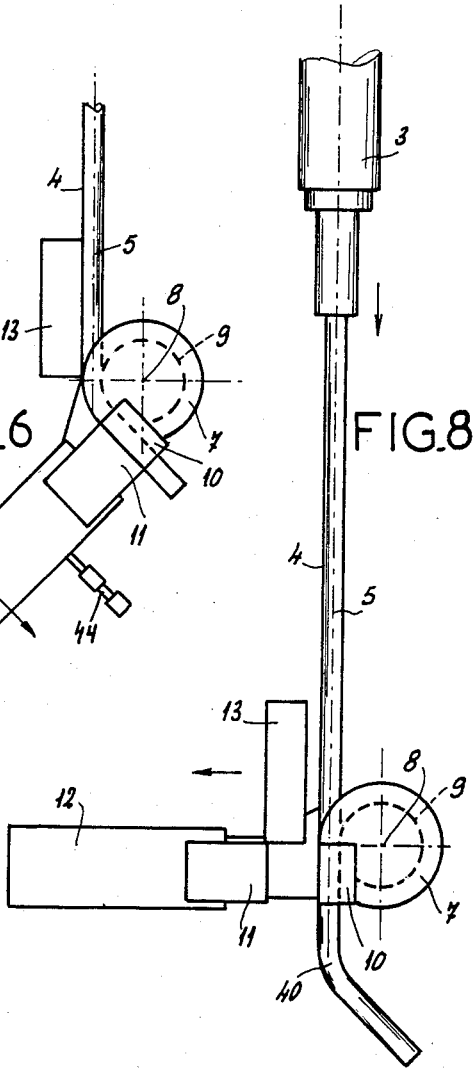

Thereafter as illustrated in FIGS. 7 and 8 the actuator 36 drops the outer jaw 11 down and out of the way and the actuator 39 transversely retracts the guide 13. Meanwhile the holder 3 advances the workpiece 4 axially somewhat, so that the mandrel 7 can be rotated back to its starting position.

Figure 9:
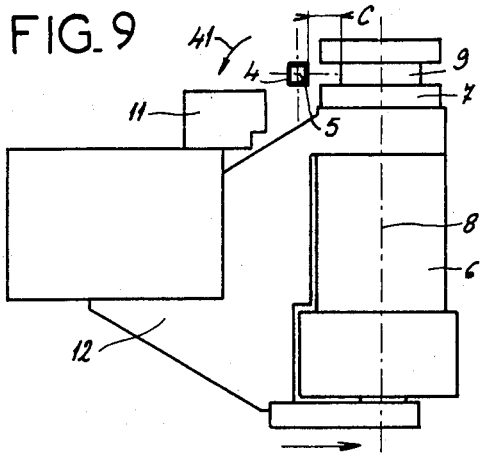
FIGS. 9 and 10 are views like respective FIGS. 4 and 5 showing the machine in the fourth step of the bending operation.
Figure 11:
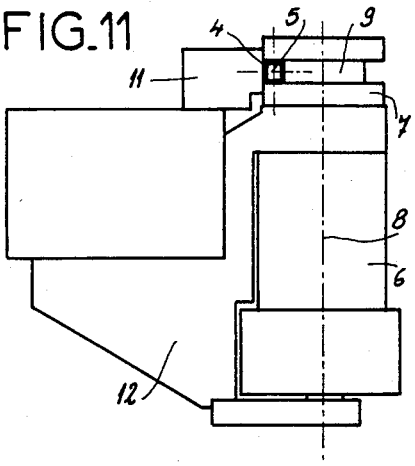
FIGS. 11 and 12 are views like respective FIGS. 4 and 5 showing the machine in the fifth and final stage of the bending operation.
Figure 10:
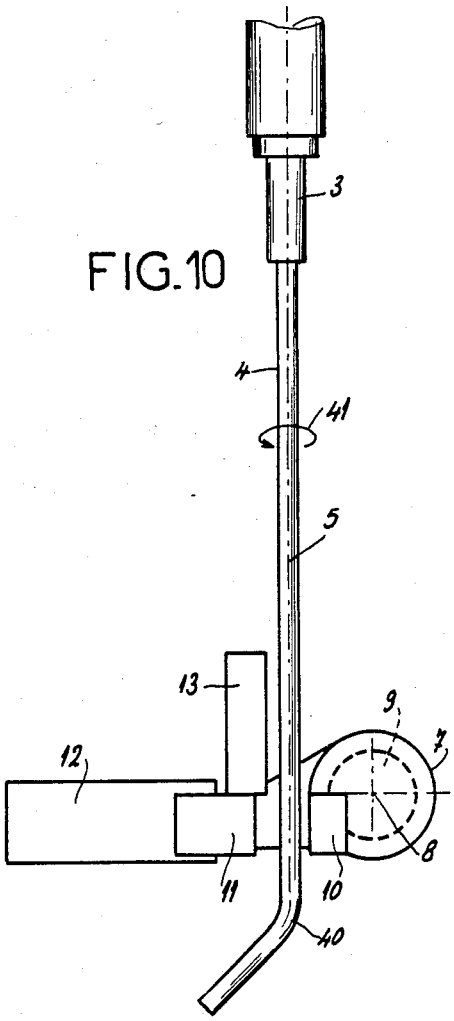
Figure 12:
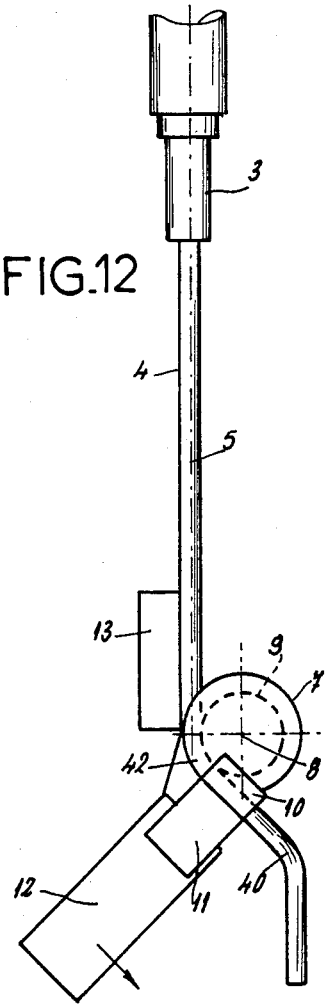

FIGS. 9 and 10 then illustrate how then the chamber 50 is pressurized to move the jaw 10 and mandrel 7 transversely of the axis 5 away from the workpiece 41, which then can be rotated through 180° about this axis 5 by the holder 3.

The jaws 10 and 11 can then be moved in with the guide 13 and turret 7, and the support 6 can again be pivoted to form an opposite bend in the workpiece.

Thus with the system of this invention even a square-section workpiece can be multiply bent with nonaligned bends. The various tools are pulled out of contact with the tube so that it can be rotated for reverse bending.

We claim:

1. A machine for bending an elongated workpiece extending along a longitudinal axis, the machine comprising:

a housing;

holding means on the housing for retaining the workpiece with its axis nondisplaceable relative to the housing and for advancing the workpiece in a feed direction parallel to the axis;

a support defining a mandrel axis transverse to the longitudinal axis and spaced transversely therefrom, the support and the mandrel axis being displaceable on the housing transverse to the longitudinal workpiece axis;

a mandrel carried directly on the support and formed with an arcuate groove centered on the mandrel axis, the mandrel carrying an inner jaw forming a continuation of the groove and being rotatable therewith on the support about the mandrel axis;

an arm mounted directly on the support pivotal about the mandrel axis and carrying an outer jaw generally complementary to the inner jaw;

a guide carried directly on the housing mainly upstream of the mandrel and having a guide groove confronting the groove of the mandrel and centered on the longitudinal workpiece axis;

jaw actuator means for displacing the outer jaw on the arm radially of the mandrel axis;

guide actuator means for displacing the guide on the housing transversely of the feed direction and independently of the support;

support actuator means for displacing the support and the jaws and mandrel carried thereby transverse to the direction and independently of the guide; and pivot actuator means for pivoting the support about the mandrel axis to bend the workpiece between the jaws and the guide, the support actuator means including an electric motor carried on the housing, a spindle rotationally coupled to the electric motor, extending perpendicular to the mandrel axis, and threaded into the support for displacing the support relative to the housing prior to pivoting of the support and bending of the workpiece, a tubular piston fixed on and coaxially receiving the spindle, and a cylinder fixed on the housing and forming a pair of oppositely effective hydraulic compartments flanking the piston for displacing the support relative to the housing after pivoting of the support and bending of the workpiece.

2. The bending machine defined in claim 1 wherein the arm includes a slide carrying the outer jaw and a guide along which the slide can move between an upper position confronting and closely juxtaposed with the inner jaw and a lower position below and spaced radially of the mandrel axis from the inner jaw, the jaw actuator means displacing the slide along its guide.

* * * * *